US006069611A

United States Patent [19]

Flynn et al.

[11] Patent Number: 6,069,611

[45] Date of Patent: May 30, 2000

[54] DISPLAY PALETTE PROGRAMMING UTILIZING FRAMES OF DATA WHICH ALSO CONTAIN COLOR PALETTE UPDATING DATA TO PREVENT DISPLAY DISTORTION OR SPARKLE

[75] Inventors: David Walter Flynn; Ashley Miles Stevens, both of Cambridge; Lance Gregory Howarth, Cherry Hinton, all of United Kingdom

[73] Assignee: Arm Limited, Cambridge, United Kingdom

[21] Appl. No.: 08/828,938

[22] Filed: Mar. 28, 1997

[30] Foreign Application Priority Data

Apr. 2, 1996 [GB] United Kingdom ..... 9606922

[51] Int. Cl.[7] ..... G09G 5/02; G09G 5/04; G09G 5/06

[52] U.S. Cl. ..... 345/150; 345/186; 345/199

[58] Field of Search ..... 345/150, 145, 345/153, 155, 199, 525, 509, 515, 507, 186, 510, 154

[56] References Cited

U.S. PATENT DOCUMENTS

| | | | |
|---|---|---|---|
| 4,386,345 | 5/1983 | Narveson et al. | 345/150 |
| 4,799,053 | 1/1989 | Van Aken et al. | 345/189 |
| 4,823,120 | 4/1989 | Thompson et al. | 345/199 |
| 4,870,406 | 9/1989 | Gupta et al. | 345/145 |
| 5,170,468 | 12/1992 | Shah et al. | 345/186 |
| 5,389,947 | 2/1995 | Wood et al. | 345/153 |
| 5,426,448 | 6/1995 | Seal et al. | 345/153 |
| 5,446,482 | 8/1995 | Van Aken et al. | 345/150 |

FOREIGN PATENT DOCUMENTS

| | | |
|---|---|---|
| 0 433 881 A2 | of 1990 | European Pat. Off. . |
| 0 385 449 | 9/1990 | European Pat. Off. . |
| 0 392 551 | 10/1990 | European Pat. Off. . |
| 0 443 581 | 8/1991 | European Pat. Off. . |
| 0 590 778 A1 | of 1993 | European Pat. Off. . |
| 0 539 822 | 5/1993 | European Pat. Off. . |
| 0 645 691 A1 | of 1994 | European Pat. Off. . |
| WO 94/10677 | of 1994 | WIPO . |

OTHER PUBLICATIONS

"Frame Buffer Data Used as RamDac Commands", IBM Technical Disclosure Bulletin, vol. 38, No. 2, Feb. 1995, pp. 623–624.

"Method of Data Writing toi Palette/Digital Analog Converter for Graphics System", IBM Technical Disclosure Bulletin, vol. 38, No. 4, Apr. 1995, pp. 125–126.

Van Aken et al., "Color Palette Chip Squeezes 4096 Hues Out of 4–Bit Pixels", Electronic Design, vol. 33, No. 3, Dec. 26, 1985, pp. 91–95.

*Primary Examiner*—Steven J. Saras
*Assistant Examiner*—Paul A. Bell
*Attorney, Agent, or Firm*—Nixon & Vanderhye P.C.

[57] ABSTRACT

A display palette system comprising a digital palette 16 supplied with frames of data 26. Each frame of data 26 includes a complete set of palette mapping data and control data 28 with which the digital palette 16 is programmed under control of a palette control circuit 24. The rows of logical pixel data that follow in the frame each terminate with row palette data RP that can be directed to reprogram the digital palette 16 part of the way through the display of a single frame.

13 Claims, 2 Drawing Sheets

DISPLAY PALETTE PROGRAMMING UTILIZING FRAMES OF DATA WHICH ALSO CONTAIN COLOR PALETTE UPDATING DATA TO PREVENT DISPLAY DISTORTION OR SPARKLE

BACKGROUND OF THE INVENTION

1. Field of the Invention

This invention relates to the field of display palettes that serve to map logical pixel values into physical appearance values.

2. Description of the Prior Art

It is known to provide electronic apparatus, such as computers, with a display palette system that serves to allow selection of a set of working colours (or other appearance parameters) for display from all possible displayable colours. More particularly, they serve to map a logical pixel value (for example generated by a software program) to a physical appearance value (such as a component RGB intensity value) that can be used to drive a display device. Such display palette systems can provide a great deal of flexibility in terms of the pixel appearance that can be made to appear on the display.

It is known that systems incorporating a display palette system may operate in a number of different modes with different mappings between logical pixel values and physical appearance values being used in the different modes. An example of this would be changing the number of bits of each logical pixel value to achieve a data size appropriate to the image being displayed. If fewer bits are used for each logical pixel value then a smaller number of different physical appearance values may be specified. In order to deal with this, the display palette circuit is reprogrammed for each different mode with a different set of pixel mapping data being stored within the display palette circuit in each mode.

Different modes such as the above are usually selected before any processing or display starts and then remain current throughout that processing or display. An additional degree of sophistication that may be desired is the ability to reprogram the display palette during on going image display without interrupting that image display. One way this has been done in the past is to reprogram the palette mapping data during the vertical flyback time of a raster display system such that the palette mapping data is only changed when it was not being used. A problem with this is that if changes in the palette mapping data overrun the flyback period and occur at the start of a frame of image display then display distortion at the start of the image can occur (this phenomenon can be seen as image "sparkle" at the top of an image). A further problem is that the software or other control that is being used to change the palette mapping data must be synchronised with the vertical synchronising signal of the display such that the times when the display palette is not being used may be properly identified. This need to synchronise to the vertical synchronisation signal places a constraint on the system design that is in many cases unwelcome, e.g. requiring particular interrupt service response with a fixed time.

It is an object of the invention to address the above mentioned problems.

SUMMARY OF THE INVENTION

Viewed from one aspect the present invention provides apparatus for generating physical signal values for controlling an output device, said apparatus comprising:

(i) a frame generator for generating frames of data including logical signal values;

(ii) a frame memory for storing said frames of data prior to output by said output device;

(iii) a palette circuit for receiving logical signal values from said frame generator and for mapping said logical signal values to physical signal values according to palette mapping data stored within said palette circuit;

(iv) wherein, within each frame of data stored within said frame memory, at least one portion of said frame of data at a predetermined position within said frame memory is reserved for transmitting updating palette mapping data from said frame generator to said palette circuit to update said palette mapping data stored in said palette circuit.

The invention recognises that by embedding the palette mapping data within the frames of data themselves that contain the logical signal values that are to be mapped, an appropriate synchronisation between the palette mapping data and the receipt of logical signal values that require mapping can be guaranteed. Thus, palette reprogramming upon receipt of updating palette mapping data does not overlap with the receipt of logical signal values and so sparkle due to the above mentioned effect can be eliminated. Furthermore, since the updating palette mapping data is embedded within each frame of data, no special synchronisation with the vertical synchronising signals of the output device need be achieved so easing other system design constraints.

It will be appreciated that the physical signal values could represent many different required outputs, e.g. the physical signal values could be audio output signals with the palette mapping data being a stereo position for a given sound. However, in a preferred embodiment, said physical signal values are physical appearance values, said logical signal values are logical pixel values and said output device is a display.

Whilst the updating palette mapping data may comprise a subset of the complete palette mapping data needed, in preferred embodiments of the invention said updating palette mapping data comprises a complete set of palette mapping data specifying a mapping to a physical appearance value for each possible logical pixel value.

Providing a complete set of palette mapping data within each frame enables each frame to be entirely self contained so making it easier to control changes in the palette mapping data and to allow for effectively instantaneous changes in the palette mapping data between adjacent frames.

Whilst the complete set of palette mapping data could be transmitted at the beginning or the end of the frame, it is preferred that said complete set of palette mapping data is transmitted within each frame prior to transmission of any logical pixel values for said frame.

By transmitting the complete set of palette mapping data prior to the logical pixel values to which it relates, an immediate effect of palette remapping can be made for the pixel frame in question without having palette mapping changes only affecting the succeeding frame.

The self-contained and complete nature of the frame data allows for the provision of one or more externally accessible connections at which said frames of data may be captured such that a further palette circuit and a further display may be used to display images represented by said frames of data.

Such externally accessible connections can be extremely useful during the development of a system incorporating the present invention. Such externally accessible connections may be tapped into by a completely separate display system that may be used to display the data that is being sent to the usual display and so aid in identifying and solving any problems that may be occurring with that usual display. The self contained nature of the frames of data that include within themselves the complete palette mapping data enables this separate display system to capture all of the information it requires to display the image without having to recover data from otherwise inaccessible portions of the system.

Whilst the logical pixel values may be transmitted in any order, it is preferred that said logical pixel values are transmitted as a plurality of rows of data in a raster format.

In practice, most display technologies are set up so as to receive the physical appearance of values that drive them in a raster format and so it is appropriate that the logical pixel values should be fed to the display palette in this order so as to generate the expected nature of output without requiring excessive storage capacity within the display palette.

A further advantage of the raster format is that a portion of each row of data is reserved for said updating palette mapping data such that said mapping from logical pixel values to physical appearance values can be modified during a display row flyback period part way through a frame.

Allowing a portion of each row to be reserved for updating palette mapping data allows the reprogramming of the palette circuit to take place part of the way through the display of a given frame of image without sparkle occurring or the need for the synchronisation with the display to be monitored. One way in which this could be used is to reprogram the palette as a change in image content occurs at a particular horizontal line in the image (i.e. at a particular vertical position), such as changing from sky to ground in an image where the palette may be reprogrammed from values best suited to the display of blue skys to values best suited to the display of a green or brown ground.

In a similar way to that in which updating palette mapping data may be embedded within the frames of data, it is also preferred that control data for other operational parameters of the palette circuit may also be embedded within the frames of data. This control data may for example control the switching of display modes or be used to enable or disable the display to provide switch on and switch off that is automatically synchronised with the image frames.

The present invention is particularly useful in systems in which said frame generator includes a multiple frame buffer memory in which said frames of data are assembled prior to being displayed.

Since the palette data is already contained with the frame, no additional work need be done at the time when a new frame is to be drawn by taking the updated data from a new area within the buffer memory so avoiding interrupt and software constraint problems.

In preferred embodiments that provide improved flexibility in modes using low numbers of bits per pixel said portion of each row of data includes address bits that are concatenated with logical pixel values to generate palette addresses that store corresponding physical appearance values to be used for that row.

Viewed from another aspect the present invention provides a method of generating physical signal values for controlling an output device, said method comprising the steps of:

(i) generating frames of data including logical signal values;

(ii) storing said frames of data within a frame memory prior to output by said output device;

(iii) mapping said logical signal values to physical signal values according to palette mapping data stored within a palette circuit;

(iv) wherein, within each frame of data stored within said frame memory, at least one portion of said frame of data at a predetermined position within said frame memory is reserved for transmitting updated palette mapping data to said palette circuit to update said palette mapping data stored in said palette circuit.

The above, and other objects, features and advantages of this invention will be apparent from the following detailed description of illustrative embodiments which is to be read in connection with the accompanying drawings.

DESCRIPTION OF THE PREFERRED EMBODIMENTS

Figure 1:
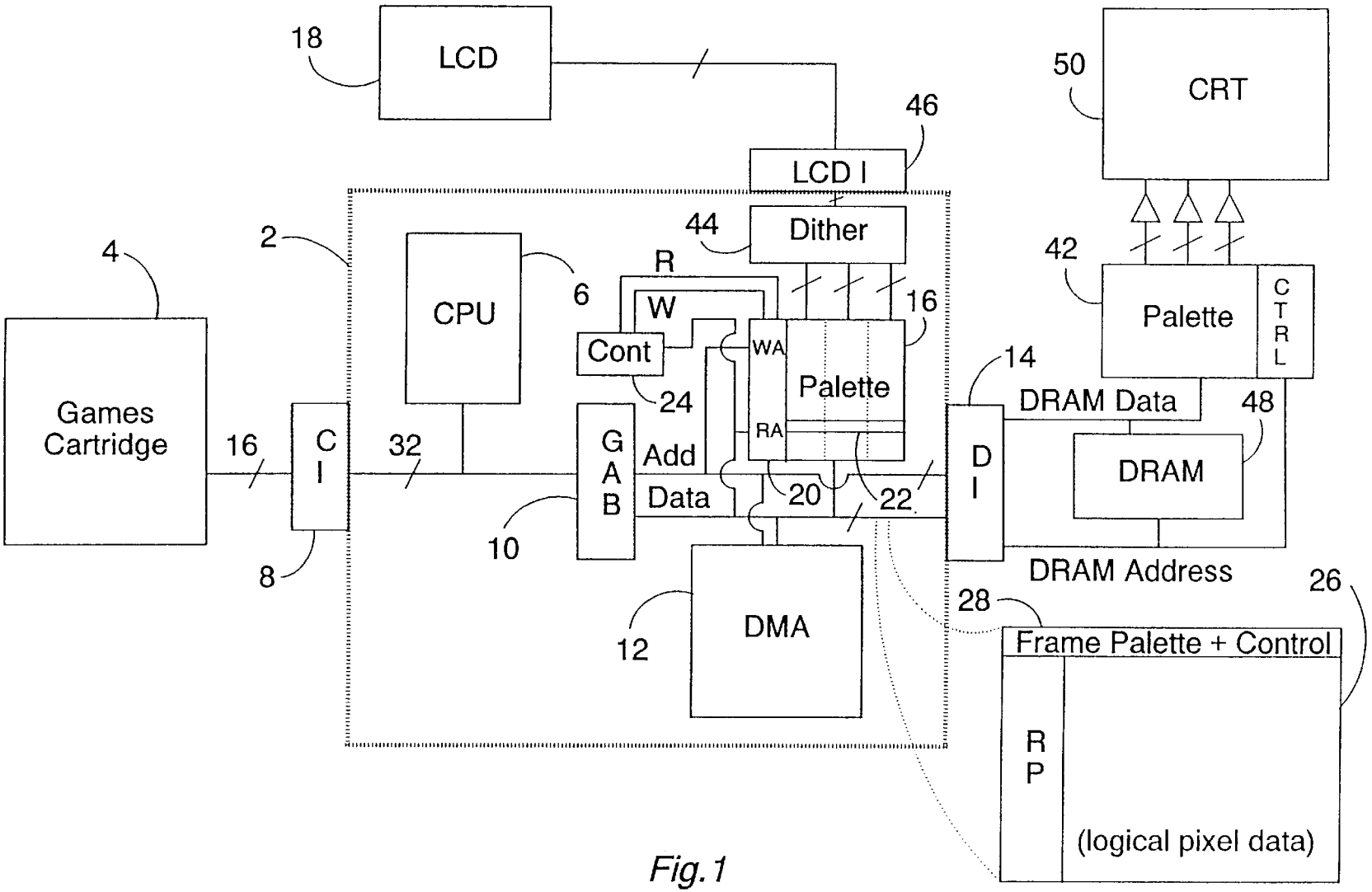
FIG. 1 illustrates a computer games system incorporating a display palette.
Figure 2:
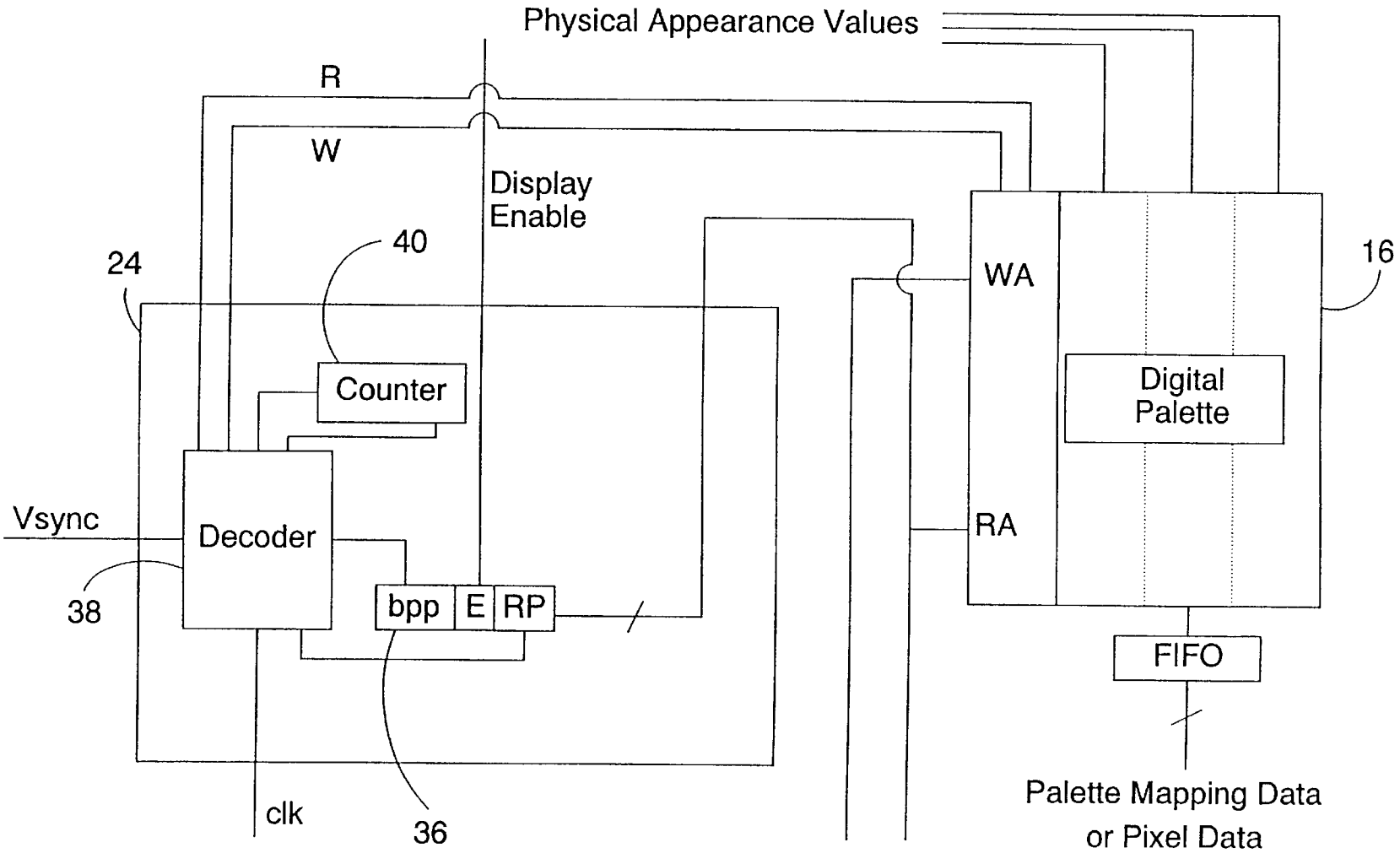
FIG. 2 illustrates the display palette of FIG. 1 in more detail.

FIG. 1 illustrates a computer games system incorporating a display palette; and FIG. 2 illustrates the display palette of FIG. 1 in more detail.

FIG. 1 illustrates a computer games system incorporating a main application specific integrated circuit (ASIC) 2 coupled via a 16-bit bus to a games cartridge 4. The games cartridge 4 typically comprises a read only memory circuit containing the control software, image data and sprites needed by the main ASIC 2. The ASIC 2 includes a central processing unit core 6 that is coupled via a cartridge interface 8 to the games cartridge 4. A graphics assist buffer 10 and internal memory 12 are also present. The cartridge interface 8, the central processing unit core 6 and the graphics assist buffer 10 are all joined via a 32-bit bus. The graphics assist buffer 10 and the internal memory 12 are coupled via a data bus and an address bus that are also passed out of the ASIC 2 by externally accessible connection pins 14 to drive an optional external palette 42.

An internal palette 16 disposed within the ASIC 2 has a capacity sufficient to map 256 logical pixel values to three corresponding physical appearance values that are supplied to a colour liquid crystal display 18 via a dither circuit 44 (for producing LCD pixel intensities) and LCD interface 46. Each physical appearance value is four bits in length allowing each physical appearance value to control a colour component to one of sixteen intensity levels.

When the digital palette 16 is used to map between logical pixel values and physical appearance values, a logical pixel value is supplied as a read address (RA) to an address decoder 20 of the digital palette 16 that then serves to select a corresponding row 22 within the digital palette 16 and output the contents of this row as three physical appearance values to the colour liquid crystal display 18. A palette control circuit 24 serves to control the reprogramming of the contents of the digital palette as will be described in more detail below.

A 16-bit data bus and a 22-bit address bus link the graphics assist buffer 10 and the internal memory 12 to the digital palette 16. When a frame of data is being read from the internal memory 12, the logical pixel values on the data bus are provided as a read address via a read port RA to the digital palette 16. When palette updating data is being supplied from the data bus for writing into the digital palette 16, a write address is provided to the digital palette 16 via a write port WA from the address bus. The digital palette 16 functions as a dual-port memory. The digital palette 16 may, in an alternative embodiment, function as a single port memory with a dedicated circuit serving to generate the palette addresses whilst the updating palette data is loaded.

The internal memory 12 provides a multiple frame buffer from which complete frames of data, including all embedded palette data, may be assembled prior to being selected for display. An individual frame of data 26 is illustrated. This frame of data 26 is read out on the 16-bit data bus in a horizontal raster scan order with a controller 24 serving to switch the mode of digital palette 16 between using this data on the data bus to address physical appearance values via the read address port or using it to update the mapping data stored within the digital palette 16 with addresses within the digital palette 16 being supplied on the address bus.

The first two lines of data 28 within the frame of data 26 contain a complete set of palette mapping data together with a number of items of control data. This is followed by 224 horizontal lines each composed of 16 bytes of row palette mapping data and 240 bytes of logical pixel data.

FIG. 2 illustrates the digital palette 16 and the palette control circuitry 24 in more detail. The 16-bit data on the data bus is supplied to a FIFO for input as mapping data to the digital palette 16 and as read address data to the digital palette 16. Depending upon the current mode of the digital palette 16, this data is either used to address a physical appearance value using the read address port or is used to overwrite existing mapping data within the digital palette 16 via the FIFO. When the data on the 16-bit databus is being used to update the contents of the mapping data within the digital palette 16, addresses within the digital palette 16 to which the new data is to be written are taken from the lower order bits of the 22-bit address bus which is cycled through an appropriate sequence of incrementing addresses.

The mode of the digital palette 16 is controlled by mode control signals R and W generated by a decoder 38 within the control circuit 24. The decoder 38 is responsive to vertical synchronising signals (generated within the ASIC to indicate the start of a frame read) and clock signals that are used to indicate the point within the frame of data 26 that has currently been reached. A counter 40 assists in this operation. The row palette data RP at the start of each line may be written into the digital palette 16 by an appropriate switching of the palette mode by the decoder 38. The row palette may be disabled if appropriate. The first byte of data within the frame 26 comprises a control word that specifies parameters relating to the display, i.e. the number of bits per pixel, whether or not the display is enabled and whether or not the row palette is enabled. These control parameters are loaded into a register 36 from where they may be driven off-chip or supplied to the decoder 38 as appropriate. When logical pixel data is being received, the logical pixel values select rows within the digital palette 16 from which the physical appearance values that have been loaded into the digital palette 16 are read out and supplied to the colour liquid crystal display 18. Within the 16 bytes at the beginning of each line that contain the row palette data, each two-byte unit is treated as a 4-bit address to one of 16 locations within the digital palette 16 and a corresponding 12-bit physical appearance value to be loaded into that selected location. The row palette may also be loaded at the end of each row, but doing this at the beginning of the row allows the row palette data to directly control the display of the pixels of the same row which is easier for software control.

Thus, at a high level the first portion of the frame data 26 is used to load a complete set of palette mapping data together with some control data, this being followed by the logical pixel data with row palette data at the beginning of each line.

The control register 36 is loaded with an enabled bit E that is used to either switch on or switch off the colour liquid crystal display 18. A number of bits per pixel value bpp serves to specify the number of bits per pixel that have been used within the logical pixel data. The two main modes are 8 bpp in which a full byte is used for each value with 256 possible different colours being available within the digital palette 16. The second mode is 4 bpp in which only four bits of a byte are used and only 16 different colours are available within the digital palette 16. A row palette enable bit RP serves to enable and disable modification of palette mapping data partway through a frame. If the row palette enable bit RP is not set, then the first sixteen bytes of each row are discarded.

Returning to FIG. 1, the pins 14 on the exterior of the ASIC 2 carry all of the data that comprises the frame of data 26 as well as signals for accessing external DRAM 48. Within a development environment, these signals may be captured relatively easily and supplied to the external palette 42 and display 50 (such as a CRT display). The frame of data contains all of the information needed to display the image that is intended to be produced with no hidden state information within the ASIC 2 to which it would otherwise be very difficult to gain access.

In the 4 bpp mode the row palette data can be used in a different way. The frame palette loads 256 possible colours at the start of each frame and these may be considered to be divided into 16 groups of 16 colours. The top four bits of the palette address indicate which group is concerned. The row palette downloads with each row a 16 entry by 4 bit look up table which specifies the top four bits to be concatenated with each 4 bit logical pixel value to form a palette address. Thus, each 4 bit logical pixel value may reference a different one of the 16 groups. Although only 16 colours can be displayed on each line, you can choose these independently for each row.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. Apparatus for generating physical signal values for controlling an output device, said apparatus comprising:

(i) a frame generator for generating frames of data including logical signal values;

(ii) a frame memory for storing said frames of data prior to output by said output device;

(iii) a palette circuit for receiving logical signal values from said frame generator and for mapping said logical signal values to physical signal values according to palette mapping stored within said palette circuit;

(iv) wherein, within each frame of data stored within said frame memory, at least one portion of said frame of data at a predetermined position within said frame memory is reserved for transmitting updating palette mapping data from said frame generator to said palette circuit to update said palette mapping data stored in said palette circuit, wherein said physical signal values are physical appearance values, said logical values are logical pixel values and said output device is a display, wherein said logical pixel values are transmitted as a plurality of rows of data in a raster format, wherein a portion of each row of data is reserved for said updating palette mapping data such that said mapping from logical pixel values to physical appearance values can be modified during a display row flyback period part way through a frame, wherein a portion of each frame is reserved for control data for controlling operational parameters of said palette circuit other than said mapping and said control data includes a row palette enable signal for enabling and disabling updating of said palette mapping data part way through a frame.

2. Apparatus for generating physical signal values for controlling an output device, said apparatus comprising:

(i) a frame generator for generating frames of data including logical signal values;

(ii) a frame memory for storing said frames of data prior to output by said output device;

(iii) a palette circuit for receiving logical signal values from said frame generator and for mapping said logical signal values to physical signal values according to palette mapping stored within said palette circuit;

(iv) wherein, within each frame of data stored within said frame memory, at least one portion of said frame of data at a predetermined position within said frame memory is reserved for transmitting updating palette mapping data from said frame generator to said palette circuit to update said palette mapping data stored in said palette circuit, wherein said physical signal values are physical appearance values, said logical values are logical pixel values and said output device is a display, wherein said logical pixel values are transmitted as a plurality of rows of data in a raster format, wherein a portion of each row of data is reserved for said updating palette mapping data such that said mapping from logical pixel values to physical appearance values can be modified during a display row flyback period part way through a frame, wherein a portion of each frame is reserved for control data for controlling operational parameters of said palette circuit other than said mapping and said portion of each row of data includes address bits that are concatenated with logical pixel values to generate palette addresses that store corresponding physical appearance values to be used for that row.

3. Apparatus for generating physical signal values for controlling an output device, said apparatus comprising:

(i) a frame generator for generating frames of data including logical signal values;

(ii) a frame memory for storing said frames of data prior to output by said output device;

(iii) a palette circuit for receiving logical signal values from said frame generator and for mapping said logical signal values to physical signal values according to palette mapping data stored within said palette circuit;

(iv) wherein, within each frame of data stored within said memory, at least one portion of said frame of data at a predetermined position within said frame memory is reserved for transmitting updating palette mapping data from said frame generator to said palette circuit to update said palette mapping data stored in said palette circuit;

(v) wherein said physical signal values are physical appearance values, said logical values are logical pixel values and said output device is a display;

(vi) wherein said updating palette mapping data comprises a complete set of palette mapping data specifying a mapping to a physical appearance value for each possible logical pixel value; and (vii) further comprising one or more externally accessible connections at which said frames of data may be captured such that a further palette circuit and a further display may be used to display images represented by said frames of data.

4. Apparatus as claimed in claim 3, wherein said complete set of palette mapping data is transmitted within each frame prior to transmission of any logical pixel values for said frame.

5. Apparatus as claimed in claim 3, wherein said logical pixel values are transmitted as a plurality of rows of data in a raster format.

6. Apparatus as claimed in claim 3, wherein a portion of each frame is reserved for control data for controlling operational parameters of said palette circuit other than said mapping.

7. Apparatus as claimed in claim 6, wherein said control data is transmitted within each frame prior to transmission of any logical pixel values for said frame.

8. Apparatus as claimed in claim 6, wherein said physical signal values are physical appearance values, said logical values are logical pixel values and said output device is a display and said control data includes at least one of:

a display enable signal for controlling enabling and disabling of a display connected to receive said physical appearance values; and a bits per pixel mode signal for specifying a number of bits comprising each logical pixel value.

9. Apparatus as claimed in claim 3, wherein said frame memory is a multiple frame buffer memory in which said frames of data are assembled prior to being displayed.

10. Apparatus for generating physical signal values for controlling an output device, said apparatus comprising:

(i) a frame generator for generating frames of data including logical signal values;

(ii) a frame memory for storing said frames of data prior to output by said output device;

(iii) a palette circuit for receiving logical signal values from said frame generator and for mapping said logical signal values to physical signal values according to palette mapping data stored within said palette circuit;

(iv) wherein, within each frame of data stored within said memory, at least one portion of said frame of data at a predetermined position within said frame memory is reserved for transmitting updating palette mapping data from said frame generator to said palette circuit to update said palette mapping data stored in said palette circuit;

(v) wherein said physical signal values are physical appearance values, said logical values are logical pixel values and said output device is a display;

(vi) wherein said updating palette mapping data comprises a complete set of palette mapping data specifying a mapping to a physical appearance value for each possible logical pixel value; and (vii) further comprising one or more externally accessible connections at which said frames of data may be captured such that a further palette circuit and a further display may be used to display images represented by said frames of data, wherein said logical pixel values are transmitted as a plurality of rows of data in a raster format, wherein a portion of each row of data is reserved for said updating palette mapping data such that said mapping from logical pixel values to physical appearance values can be modified during a display row flyback period part way through a frame.

11. Apparatus as claimed in claim 10, wherein a portion of each frame is reserved for control data for controlling operational parameters of said palette circuit other than said mapping and said control data includes a row palette enable signal for enabling and disabling updating of said palette mapping data part way through a frame.

12. Apparatus as claimed in claim 10, wherein a portion of each frame is reserved for control data for controlling operational parameters of said palette circuit other than said mapping and said portion of each row of data includes address bits that are concatenated with logical pixel values to generate palette addresses that store corresponding physical appearance values to be used for that row.

13. A method of generating physical signal values for controlling an output device, said method comprising the steps of:

(i) generating frames of data including logical signal values;

(ii) storing said frames of data within a frame memory prior to output by said output device;

(iii) mapping said logical signal values to physical signal values according to palette mapping data stored within a palette circuit;

(iv) wherein, within each frame of data stored within said frame memory, at least one portion of said frame of data at a predetermined position within said frame memory is reserved for transmitting updated palette mapping data to said palette circuit to update said palette mapping data stored in said palette circuit;

(v) wherein said physical signal values are physical appearance values, said logical values are logical pixel values and said output device is a display;

(vi) wherein said updating palette mapping data comprises a complete set of palette mapping data specifying a mapping to a physical appearance value for each possible logical pixel value; and (vii) connecting a further palette circuit and a further display to one or more externally accessible connections at which said frames of data may be captured in order to display images represented by said frames of data.

* * * * *